US007198492B2

(12) United States Patent
Shichida et al.

(10) Patent No.: US 7,198,492 B2
(45) Date of Patent: Apr. 3, 2007

(54) COAXIAL CONNECTOR INTEGRATED CONNECTOR FOR BOARD CONNECTION

(75) Inventors: Akihito Shichida, Osaka (JP); Toru Imai, Osaka (JP); Takayuki Nagata, Osaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 11/313,530

(22) Filed: Dec. 20, 2005

(65) Prior Publication Data

US 2006/0141811 A1 Jun. 29, 2006

(30) Foreign Application Priority Data

Dec. 28, 2004 (JP) ..... 2004-378855

(51) Int. Cl.
*H01R 12/00* (2006.01)

(52) U.S. Cl. ..... 439/63; 439/74; 439/581

(58) Field of Classification Search ..... 439/63, 439/581, 660, 74, 406, 636, 637, 682
See application file for complete search history.

(56) References Cited

U.S. PATENT DOCUMENTS 5,454,734 A * 10/1995 Eggert et al. ..... 439/578
6,024,608 A 2/2000 Azuma et al.
6,902,408 B2 * 6/2005 Yamane ..... 439/63
2003/0176110 A1 * 9/2003 Wu et al. ..... 439/660
2004/0102061 A1 5/2004 Watanabe

FOREIGN PATENT DOCUMENTS

EP 1 081 807 3/2001
WO WO-97/18603 5/1997

OTHER PUBLICATIONS

Hirose Electric Co., Ltd., IT1 Series Product Catalog page High Speed, Matched-Impedance, Parallel Board-to-board Connector System, Aug. 2004.

* cited by examiner

*Primary Examiner*—Tho D. Ta
*Assistant Examiner*—Vanessa Girardi
(74) *Attorney, Agent, or Firm*—David N. Lathrop, Esq.; Gallagher & Lathrop

(57) ABSTRACT

By forming a coaxial receptacle and a coaxial plug, for which the characteristic impedances have been adjusted, at the respective end portions of a receptacle-side insulating housing and a plug-side body constituting a multi-connector being a parallel connector part, a transmission line has been made possible in which a multi-connector is mated and the signals passing through the coaxial connector at the same time exhibit little reflection and radiation.

7 Claims, 9 Drawing Sheets

COAXIAL CONNECTOR INTEGRATED CONNECTOR FOR BOARD CONNECTION

TECHNICAL FIELD

This invention pertains to a connector for board connection integrally forming a multi-connector, provided with a number of contactors and connecting two boards, and a coaxial connector having a desired characteristic impedance.

BACKGROUND ART

As multi-connectors used in signal communication requiring impedance matching between boards, there is known one in which transmission lines are given a strip-line configuration by means of four-layer boards (Non-Patent Reference: Hirose Electric Co., Ltd., IT1 Series Product Catalog). In case there are a number of signals requiring impedance matching (below, also called antenna signals or high-frequency signals), this type of connector is used. However, for signals communicating between boards, if e.g. a mobile phone is cited as an example, it is generally the case where the number of high-frequency signals requiring impedance matching is smaller than that of signals for which matching may be ignored. E.g., for antenna signals prior to conversion to the baseband, there is a need to make the characteristic impedances of the transmission paths match accurately. Regarding audio-type signals other than those, or signals like control signals for direct current voltage levels for setting LSI (Large Scale Integration) circuit operating states (including direct current signals, these are below called baseband signals or low-frequency signals), there is no need to take into account the characteristic impedance of the transmission path. Consequently, with respect to all signals, there are many cases where using a multi-connector in which the characteristic impedances are adjusted, such as that described above, is not economical.

Accordingly, for the connection of low-frequency signals for which characteristic impedances may be ignored, common multi-connectors are used and, regarding antenna signals, coaxial connectors are used for which characteristic impedances have been taken into account. Conventional examples thereof are shown in FIGS. 14A and 14B. FIG. 14A is an oblique view showing an example of conventional inter-board connection. On I/O board 131, there are installed a not illustrated antenna as well as a not illustrated speaker, sounder, and vibrating motor. On I/O board 131, there is installed a plug-side multi-connector 132 in parallel with and adjacent to a side thereof. On an extension line of plug-side multi-connector 132, there is installed, in a corner part of I/O board 131, a coaxial receptacle 134.

Plug-side multi-connector 132 on I/O board 131 is mated with a receptacle-side multi-connector 136 installed on an RF (Radio Frequency, below abbreviated as RF)/BB (Baseband, below abbreviated as BB) board 135, in parallel with and adjacent to a side thereof. To coaxial receptacle 134 on I/O board 131, there is fitted a coaxial plug 137 forming one end of a coaxial cable 133, the other end of which is soldered to RF/BB board 135. In this way, for antenna signals requiring matching of characteristic impedances, these have been connected with coaxial cables, whereas for other audio-type signals not requiring characteristic impedance matching, multi-connectors have been used.

In FIG. 14B, there is shown an oblique view showing another conventional example. Elements which are the same as in FIG. 14A are taken to have the same reference numerals and an explanation thereof will be omitted. On I/O board 131 and adjacent to a side thereof, there is installed a first flat cable receptacle 138. First flat cable receptacle 138 is mated with a first flat cable plug 139 forming one end of a flat cable 140 having a plurality of distributing wires, the claddings of which are together united in a single body on the same face. In a corner of I/O board 131 on the longitudinal direction extension line of first flat cable receptacle 138, there is installed a coaxial receptacle 134. Coaxial receptacle 134 is directly connected, without going through a cable, to a coaxial plug 137 directly installed on RF/BB board 135. In first flat cable receptacle 138 on I/O board 131, there is inserted a first flat cable plug 139 forming one end of flat cable 140. To the other end of flat cable 140, there is connected a second flat cable plug 141, second flat cable plug 141 being mated with a second flat cable receptacle 142 installed in parallel with and adjacent to a side of RF/BB board 135. In this way, there is also the method of directly connecting together coaxial connectors installed on a board for antenna signals requiring matching of characteristic impedances and carrying out transmission by using a flat cable for signals not requiring matching of the characteristic impedances.

A multi-connector in which transmission lines are given a strip-line configuration is a connector for which the characteristic impedance $Z_0$ of each transmission line is set to e.g. 50 Ω or 75 Ω, from the relationship shown in the equation $$Z_0=(L/C)^{1/2}. \quad (1)$$

L is the inductance per unit length of the transmission line and C is likewise the capacitance per unit length. As is seen from this Eq. 1, in order to adjust the characteristic impedance of each transmission line, there has been the issue of the necessity of having some size for adjustment in each transmission line, resulting in an increase in the size of the whole multi-connector. Such an increased-size multi-connector cannot be used in cellular phone terminals for which miniaturization and the process of making thinner have well advanced. Further, in equipment with few transmission lines requiring matching of characteristic impedances, the result has been the use of matched transmission lines even for signals not requiring matching, something which has been uneconomical.

Accordingly, with the background art, as mentioned, there can be obtained a method of connecting with normal multi-connectors for signals not requiring matching of characteristic impedances and using coaxial connectors for signals requiring matching.

A method can be considered wherein multi-connectors are connected together without using flat cable 140, with the method shown in FIG. 14A, and for coaxial connectors, receptacle 134 and coaxial plug 137 are directly connected without going through coaxial cable 133, with the method shown in FIG. 14B. In the case of directly installing like that a plurality of receptacle components and a plurality of plug components and making them connect all at once, there is the issue that the installation accuracy of each component relative to the others and the finishing accuracy of each component become problems, with the result that the positions of the connection parts do not fit together. If one attempts to make these connect by force, there is the possibility of destroying the connection parts, and even if a connection can be effected, that the reliability or the durability is markedly degraded.

With the objective of preventing this, the method of compensating for the inaccuracy in matching the positions with the other set of connection parts by connecting one set of a plurality of connection parts to cables, is the method shown in FIG. 14A and FIG. 14B. However, whereas it has been possible with this method to prevent the reduction in breakdowns and reliability of the connection parts, but there has been the problem that the number of components ends up increasing. Further, the fact that space is required for the pulling and turning of the cable parts and the fact that man-hours (assembly time) are required for the processing of pulling and turning the cables had become causes for cost increases.

SUMMARY OF THE INVENTION

This invention is one which takes points like these into consideration and has for its object to provide a coaxial connector integrated connector for board connection having few components, not increasing assembly man-hours, and enabling cost reductions.

With this invention, there is constituted a connector for board connection by the combination of: a receptacle wherein a first coaxial connector is integrally formed at one end portion of an insulating housing, in which rectangular parallelepiped shaped insulating housing there is formed, in the center part of a face and along the longitudinal direction thereof, a recess for insertion of a companion plug, there are respectively disposed and formed contactor accommodating slots, with a fixed pitch on opposite faces parallel to the longitudinal direction of the same insertion recess, and there are stored receptacle contactors in each contactor accommodating slot;

and a plug wherein there is integrally formed a second coaxial connector, mating with the aforementioned first coaxial connector, at one end of an insulating body, there are disposed and formed plug contactor accommodating slots, with the same pitch as described above, on both longitudinal direction sides of an insulating body mating with the aforementioned recess for receptacle insertion, and there are stored plug contactors in the aforementioned plug contactor accommodating slots.

According to this invention, as described above, it is possible, by forming a coaxial connector integrally from respectively a receptacle-side insulating housing constituting a multi-connector and a plug-side body, to manufacture in a positional relationship between a multi-connector and a coaxial connector with high accuracy. As a result, it becomes possible to connect, by one pair of connectors, signals requiring impedance matching and signals which, while not requiring impedance matching, are numerous, and there can be implemented a coaxial connector integrated connector for board connection which eliminates cables, reduces assembly man-hours, and makes cost reductions possible.

DETAILED DESCRIPTION OF THE PREFERRED EMBODIMENTS

Below, the embodiments of this invention will be explained with reference to the drawings.

1. First Embodiment

Figure 1A:
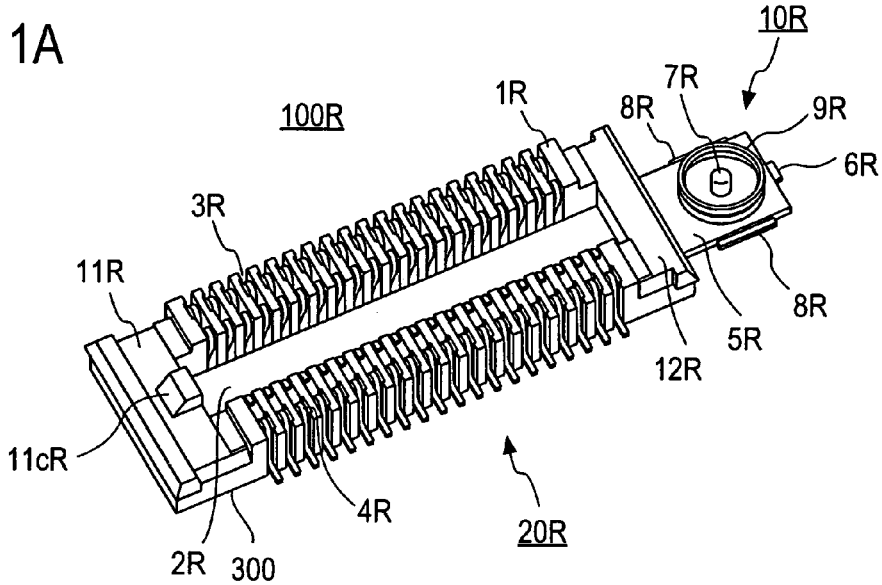
FIG. 1A is an oblique view showing an embodiment of a receptacle in a coaxial connector integrated connector for board connection according to this invention.
Figure 1B:
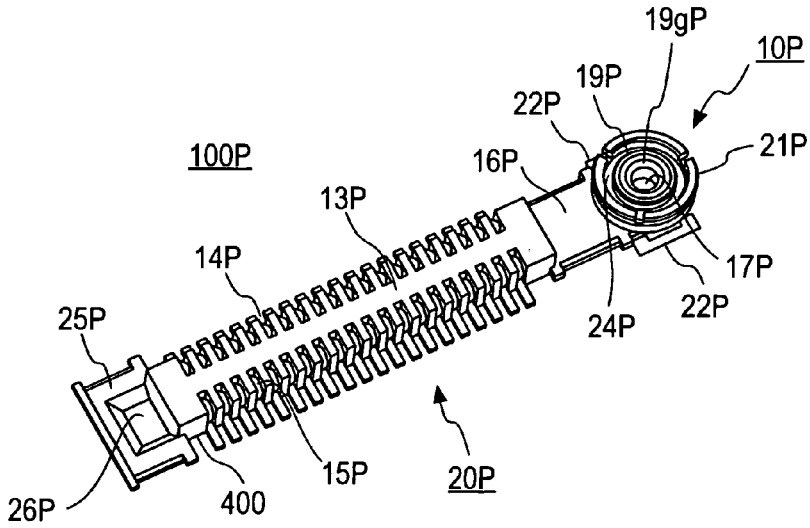
FIG. 1B is an oblique view showing an embodiment of a plug in a coaxial connector integrated connector for board connection according to this invention.
Figure 1C:
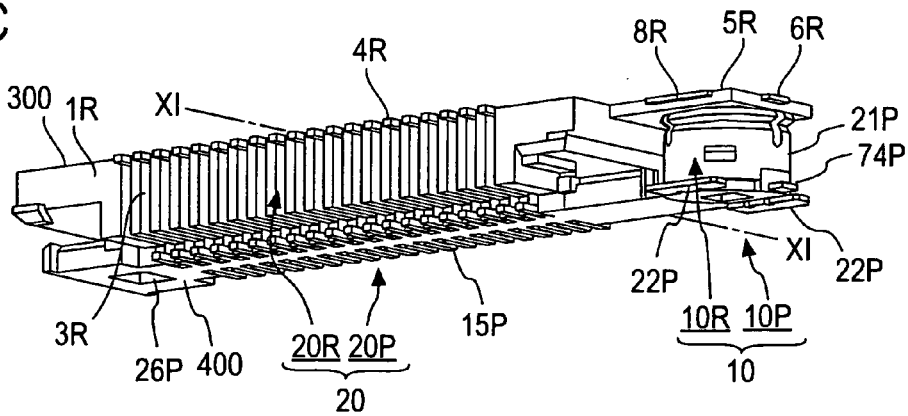
FIG. 1C is an oblique view of a connector in a state where the receptacle and the plug are coupled.

In FIGS. 1A, 1B, and 1C, there are shown oblique views of a receptacle 100R, a plug 100P, and a state where the two are mated, showing an embodiment of a connector for integrated board connection of a coaxial connector according to this invention. This receptacle 100R and this plug 100P are respectively installed on separate boards, and by respectively making them mate, the boards are connected together electrically.

(Configuration of the Receptacle)

FIG. 1A is an oblique view of an embodiment of receptacle 100R constituting a connector, of this invention, for integrated board connection of a coaxial connector. Receptacle 100R comprises a nearly parallelepiped shaped multi-connector receptacle 20R and a coaxial receptacle 10R formed integrally at one longitudinal direction end thereof. An insulating housing 1R of multi-connector receptacle 20R forming receptacle 100R is a parallelepiped which has formed therein an insertion recess 2R into which a companion plug is inserted along the longitudinal direction of the center part of a face thereof Both longitudinal direction ends of insertion recess 2R are closed by receptacle end portions 11R, 12R. On opposite faces parallel to the longitudinal direction of the same insertion recess 2R, contactor accommodating slots 3R are disposed and formed with a fixed pitch, and receptacle contactors 4R are stored respectively in each contactor accommodating slot 3R. The back face side of insertion recess 2R comes into contact with the front face of a not illustrated board (below called the installation face) on which insulating housing 1R is installed.

On the end face of receptacle end portion 12R which is on the side facing away from insulating housing 1R, a first coaxial connector forming plate portion 5R, shown rectangular in the diagram, is formed integrally by extension with a width which is narrower than the width of insulating housing 1R and with a height which is equal to the height measured from installation face 300 of insulating housing 1R in insertion recess 2R.

In the center of first coaxial connector forming plate portion 5R, a first center conductor 7R is arranged in a standing condition, perpendicularly with respect to the installation face. A first center conductor terminal 6R, which forms a metal component integrally with first center conductor 7R, connects first center conductor 7R to a not illustrated wiring pattern on installation face 300 and protrudes from a side of first coaxial connector forming plate portion 5R facing away from insulating housing 1R. This metal component forming first center conductor 7R and first center conductor terminal 6R is assembled on first coaxial connector forming plate portion 5R.

A first earth ring 9R, having a wall with nearly the same height as first center conductor 7R, is arranged in a standing condition and centered on first center conductor 7R. An earth terminal 8R, connecting first earth ring 9R to ground, protrudes from two sides of first coaxial connector forming plate portion 5R which are parallel with the longitudinal direction of insulating housing 1R, in the plane of installation face 300. First earth ring 9R and earth terminal 8R are formed integrally into a metal component and, on the occasion of manufacturing insulating housing 1R, are insert molded in a portion of first coaxial connector forming plate portion 5R.

A first coaxial connector 10R, based on first center conductor 7R and first earth ring 9R, is formed as a receptacle in first coaxial connector forming plate portion 5R. Below, first coaxial connector 10R will also be called coaxial receptacle 10R. Receptacle terminals 11R, 12R, of insulating housing 1R located on the side facing away from coaxial receptacle 10R, have a face which, on the side of installation face 300, is lower than the face in which contactor accommodating slots 3R are formed and higher than first coaxial connector forming plate portion 5R. Nearly in the center of receptacle terminal 11R, a protrusion 11cR for engagement in a position adjacent to insertion recess 2R is formed so as to protrude in a perpendicular direction with respect to installation face 300.

(Configuration of the Plug)

FIG. 1B is an oblique view showing an embodiment of plug 100P constituting a connector, of this invention, for integrated board connection of a coaxial connector. Plug 100P comprises a nearly rectangular parallelepiped shaped multi-connector plug 20P and a coaxial plug 10P formed integrally at one longitudinal direction end thereof. Multi-connector plug 20P has a nearly rectangular parallelepiped shaped insulating body 13P mating with insertion recess 2R of multi-connector receptacle 20R. On both longitudinal direction sides of insulating body 13P, plug contactor accommodating slots 14P are disposed and formed with a pitch identical to that on the receptacle side, and plug contactors 15P are stored in plug contactor accommodating slots 14P. The face on the side facing away from the direction of insertion of insulating body 13P, inserted in insertion recess 2R of multi-connector receptacle 20R, makes contact with the front face (below called the plug installation face) of a not illustrated board on which insulating body 13P is installed.

One longitudinal direction end of insulating body 13P is extended integrally to form a second coaxial connector forming plate portion 16P which has a thickness measured from plug installation face 400 on which insulating body 13P is installed that is smaller than the thickness of insulating body 13P and a width nearly the same as that of insulating body 13P. On the end of second coaxial connector forming plate portion 16P, on the side facing away from multi-connector plug 20P, a cylindrical mounting part 19P with an outer diameter nearly identical to the inner diameter of first earth ring 9R of coaxial receptacle 10R is integrally formed with insulating body 13P in a perpendicular direction with respect to plug installation face 400. In the center of the plane opposite installation face 400 of cylindrical mounting part 19P, there is made an insertion hole 17P in which first center conductor 7R of coaxial receptacle 10R is inserted, and there is formed a tapered face 19*g*P, the inner diameter of which increases outward from the front end of insertion hole 17P.

An annular gap 24P is made in the circumference of cylindrical mounting part 19P, and a second earth ring 21P is latched together with second coaxial connector forming plate portion 16P. Second earth ring 21P has an inner diameter nearly identical to the outer diameter of first earth ring 9R and nearly the same height as cylindrical mounting part 19P. On the second earth ring 21P peripheral part, running parallel with the longitudinal direction of insulating body 13P, there is formed, integrally with second earth ring 21P, a ground terminal 22P for which second earth ring 21P is soldered to a ground electrode on plug installation face 400.

Figure 7:
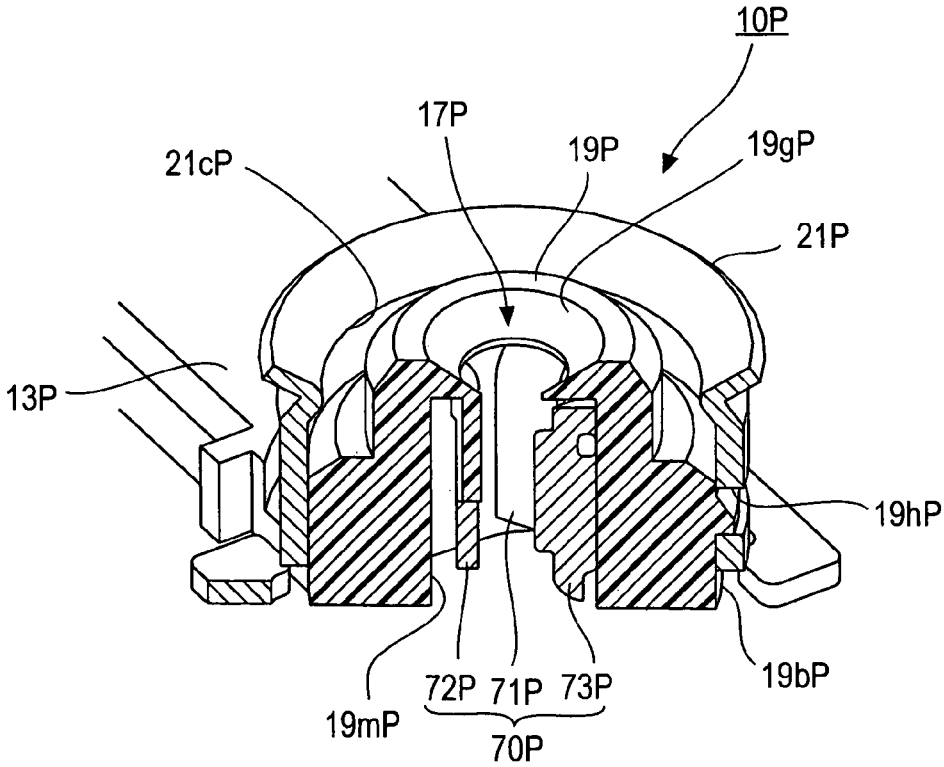
FIG. 7 is a cross-sectional view seen along line VII–VII of the coaxial plug in FIG. 5.
Figure 10:
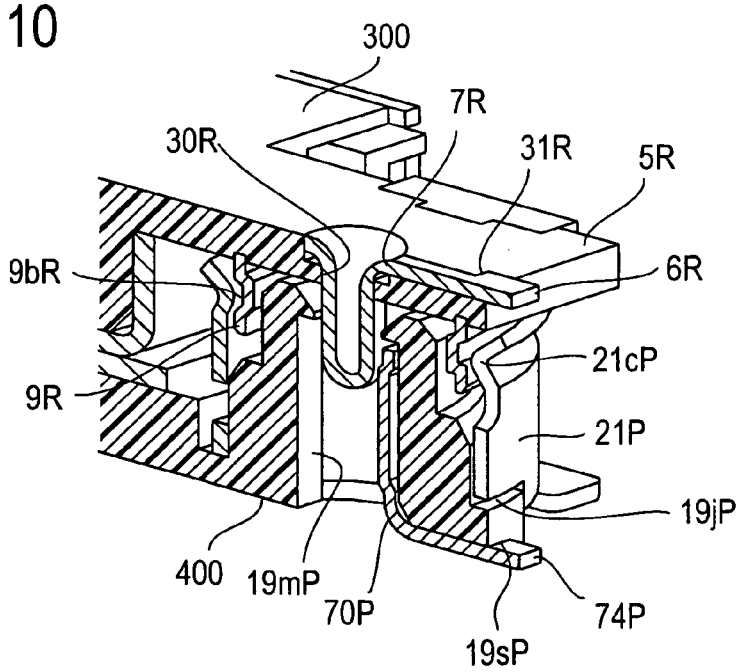
FIG. 10 is a cross-sectional view in a state where the coaxial receptacle and the coaxial plug are mated.

Insertion hole 17P formed in the upper face center portion of cylindrical mounting part 19P is a through hole oriented toward plug installation face 400, the through hole, as shown in FIGS. 7 and 10 to be subsequently described, has a radial direction which gets enlarged in the interior part of cylindrical mounting part 19P, is pierced all the way to plug installation face 400, and forms a center conductor receiving compartment 19*m*P (not shown in FIG. 1B, but shown in FIGS. 7 and 10) with a nearly square cross section. In center conductor receiving compartment 19*m*P, there is installed from plug installation face 400 a not illustrated second center conductor 70P (not shown in FIG. 1B, but shown in FIGS. 7 and 10). At the tip end of second coaxial connector forming plate portion 16P, there protrudes a second center conductor terminal 74P in the plane of plug installation face 400, which is a metal component integral with the second center conductor (refer to FIG. 10 to be subsequently described). In second coaxial connector forming plate portion 16P, a second coaxial connector 10P is formed as a coaxial plug by means of cylindrical mounting part 19P, second earth ring 21P, and the second center conductor. Below, second coaxial connector 10P is also called a coaxial plug.

In the end portion of insulating body 13P facing away from coaxial plug 10P, there is formed a plug end portion 25P which is lower, from the plug installation face 400 side, than the top face in which plug contactor accommodating slots 14P are formed, and slightly wider. In a nearly central portion of plug end portion 25P, there is formed an engagement hole 26P engaging a protrusion 11*c*R for engagement of the receptacle.

(Mating of the Receptacle and the Plug)

FIG. 1C shows an oblique view of a state in which receptacle 100R of FIG. 1A and plug 100P of FIG. 1B are mated. The combination of multi-connector receptacle 20R and multi-connector plug 20P constitutes a multi-connector part 20, and the combination of coaxial receptacle 10R and coaxial plug 10P constitutes a coaxial connector part 10. In FIG. 1C, the respective separate boards on which are installed receptacle 100R and plug 100P are not illustrated. FIG. 1C is a diagram in which engagement protrusion 11*c*R of receptacle 100R seen in FIG. 1A is engaged in engagement hole 26P of the plug, insulating body 13P is mated by insertion into insertion recess 2R, first earth ring 9R is mated by insertion into annular gap 24P of coaxial plug 10P seen in FIG. 1B, and first center conductor 7R seen in FIG. 1A is mated by insertion into insertion hole 17P seen in FIG. 1B.

One end of each of receptacle contactors 4R accommodated in contactor accommodating slots 3R formed along the longitudinal direction of rectangular parallelepiped shaped insulating housing 1R constituting the main part of receptacle 100R, protrudes outward from insulating housing 1R in the plane of installation face 300. Plug contactors 15P, having a one-to-one correspondence with receptacle contactors 4R, are arranged in the longitudinal direction of insulation body 13P of plug 100P inserted in insertion recess 2R of receptacle 100R with their ends protruding outward from insulating body 13P in the plane of installation face 400. By making contact between these receptacle contactors 4R and plug contactors 15P, it is possible to make wiring patterns conductively connected between different boards. Since this transmission line through receptacle contactors 4R and plug contactors 15P does not take into account the characteristic impedances, it is used as a transmission path for audio-type low-frequency signals, direct current voltage signals for setting the operating states of LSI circuits, and the like.

Second earth ring 21P constituting coaxial plug 10P is mated with first earth ring 9R constituting coaxial receptacle 10R. On that occasion, first center conductor 7R is inserted in insertion hole 17P bored in the center of cylindrical mounting part 19P constituting coaxial plug 10P. Further, first earth ring 9R of coaxial receptacle 10R is inserted in and mated with annular gap 24P formed between the outer peripheral face of cylindrical mounting part 19P and the inner peripheral face of second earth ring 21P of coaxial plug 10P.

Second center conductor terminal 74P protrudes outward in the plane of plug installation face 400 from one end side of second coaxial connector forming plate portion 16P on the side opposite from insulating body 13P. Ground terminal 22P, integrally formed with second earth ring 21P, protrude outwardly in a diametric direction of coaxial plug 10P in the plane of plug installation face 400 from the same two other sides of coaxial connector forming plate portion 16P as the two longer sides of insulating body 13P.

If insulating housing 1R and insulating body 13P are mated, first center conductor 7R constituting part of coaxial receptacle 10R, is, as shown in FIG. 10, inserted through insertion hole 17P formed in the center of cylindrical mounting part 19P constituting part of coaxial plug 10P into center conductor receiving compartment 19*m*P and makes contact with a second center conductor 70P (the second center conductor will be described subsequently) which is a movable electrode installed in center conductor receiving compartment 19*m*P. As a result of this, a signal on the board where insulating housing 1R is installed is transmitted, through first center conductor terminal 6R and second conductor terminal 74P to the wiring pattern on the board where insulation body 13P is installed.

The characteristic impedance of this transmission line based on coaxial receptacle 10R and coaxial plug 10P is set to e.g. 50 Ω. The adjustment of the characteristic impedance is carried out by changing the transmission line inductance and capacitance per unit length shown in Eq. 1 by modifying the outer diameter or length of first center conductor 7R, the dielectric constant of the material forming cylindrical mounting part 19P, the electrode width of first center conductor terminal 6R and second conductor terminal 74P, and the like. Consequently, by adjusting these parameters, it is possible to adjust the characteristic impedance to 50 Ω or 75 Ω.

Since, in this way, the characteristic impedance of the transmission line can be set to a desired value, it is possible to transmit, with few losses, high-frequency signals like e.g. antenna signals for which impedance matching of the transmission lines is demanded. Further, since first center conductor 7R and second center conductor 70P (described subsequently) are electro-magnetically shielded by second earth ring 21P and first earth ring 9R, the invention is suitable as a transmission line for signals in e.g. microwave circuits for the radiation of signals is a problem.

According to the embodiment shown in FIGS. 1A, 1B, and 1C, it becomes possible, for audio-type signals and LSI circuit control signals based on direct current voltage levels, to make connections between the comparatively numerous transmission paths for which characteristic impedances can be ignored, and connections between the few transmission paths for which matching of characteristic impedances must be obtained, with one connector for connection between boards.

According further to the embodiment shown in FIGS. 1A, 1B, and 1C, it is possible to reduce the thickness of the connector in the mating state since the thickness of first coaxial connector forming plate portion 5R and second coaxial connector forming plate portion 16P is formed to be thinner than insulating housing 1R and insulating body 13P, respectively.

In the embodiment shown in FIGS. 1A, 1B, and 1C, an example was shown where the coaxial receptacle was formed as coaxial connector 10R integrally with insulating housing 1R forming part of multi-connector receptacle 20R, and the coaxial plug was formed as second coaxial connector 10P integrally with insulating body 13P forming multi-connector plug 20P. This invention is not limited to this embodiment. The coaxial plug may be formed on the side of receptacle 100R and the coaxial receptacle may be formed on the side of plug 100P.

(Detailed Structure of the Coaxial Receptacle)

Figure 2:
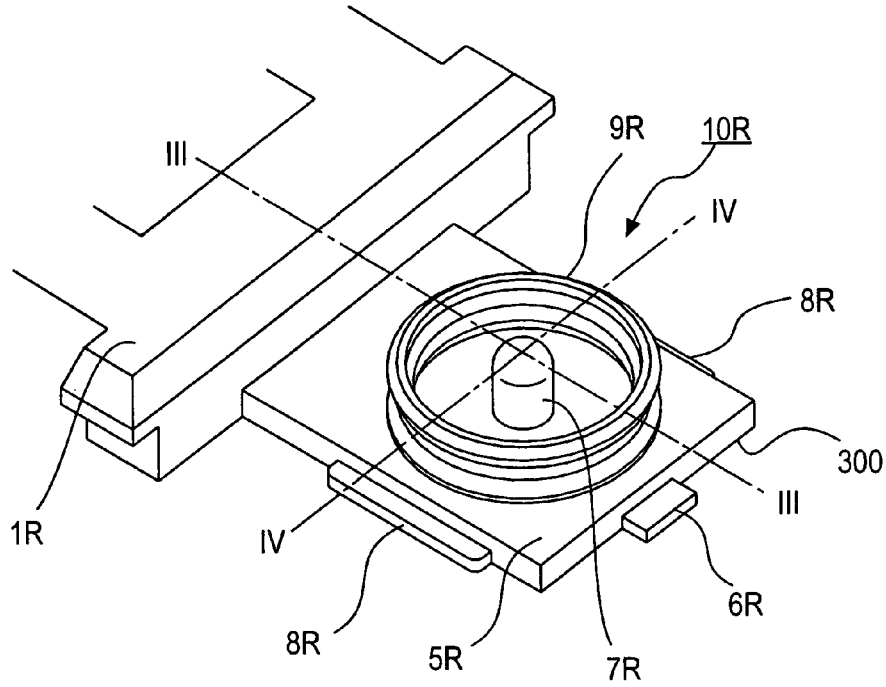
FIG. 2 is an enlarged oblique view of the coaxial receptacle in the receptacle shown in FIG. 1A.

FIG. 2 is an enlarged oblique view of coaxial receptacle 10R shown in FIG. 1A. For the portions corresponding to those shown in FIG. 1A, like reference numerals are chosen and an explanation thereof is not repeated. Explanations are added by means of FIG. 2 regarding portions for which the structure becomes more clearly defined.

First center conductor terminal 6R forming the other end of first center conductor 7R protrudes outward from the edge, facing away from multi-connector receptacle 20R, of first coaxial connector forming plate portion 5R, making the bottom face of first center conductor terminal 6R flush with installation face 300. Earth terminals 8R connecting first earth ring 9R to ground protrude outward in the plane of installation face 300 from the opposite two sides of first coaxial connector forming plate portion 5R which are parallel with the longitudinal direction of insulating housing 1R.

Figure 3:
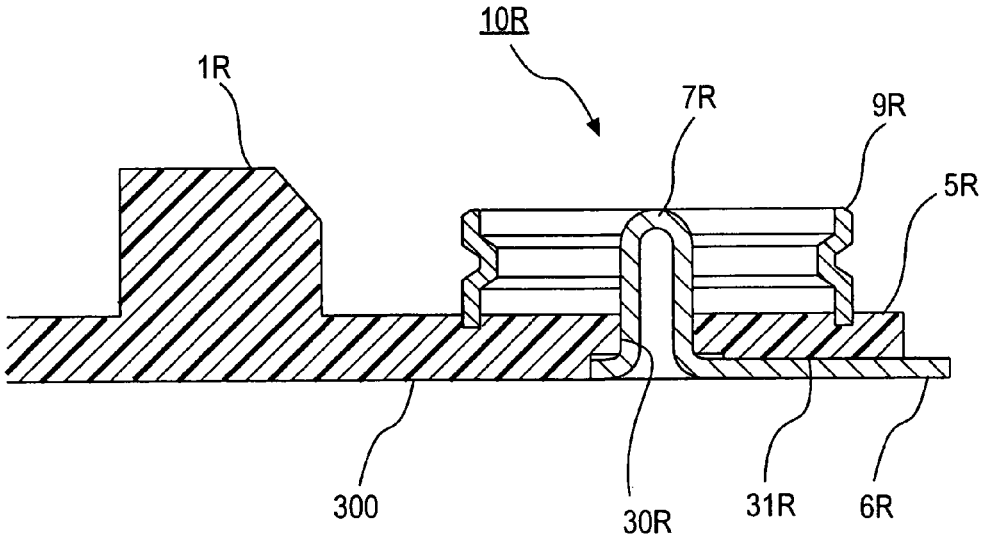
FIG. 3 is a cross-sectional view seen along the line III—III in FIG. 2.

In FIG. 3, there is shown a cross-sectional view cut along line III—III of FIG. 2. First center conductor 7R is inserted from the side of installation face 300 in an installation hole 30R made in the center portion of first coaxial connector forming plate portion 5R and held perpendicular to installation face 300. First center conductor terminal 6R, integral with first center conductor 7R and parallel with installation face 300, is fixedly held in a groove 31R formed in the plane of installation face 300 of coaxial receptacle forming part 5R. In this embodiment, the nearly L-shaped component forming first center conductor 7R and first center conductor terminal 6R was explained as being a built-in component, but it may also be insert molded when manufacturing insulating housing 1R.

Figure 4:
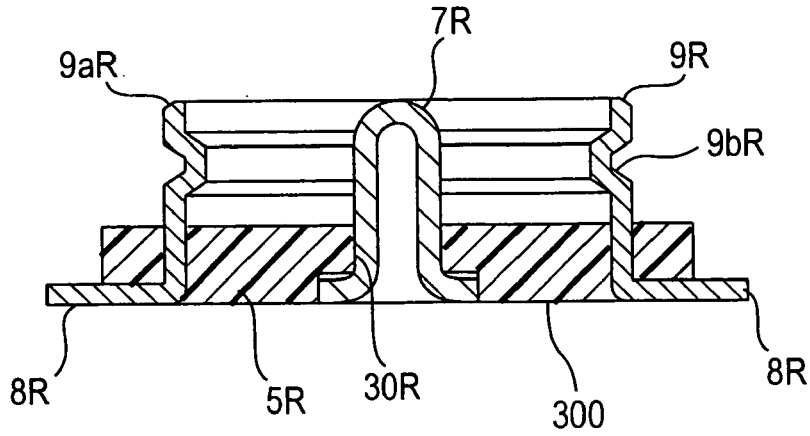
FIG. 4 is cross-sectional view seen along the line IV—IV in FIG. 2.

In FIG. 4, there is shown a cross-sectional view wherein FIG. 2 has been cut along the line IV—IV. In the center of first coaxial connector forming plate portion 5R, there is made an installation hole 30R for installation of first center conductor 7R, first center conductor 7R being inserted into installation hole 30R, and first center conductor 7R being held perpendicular to installation face 300. As for the example of first center conductor 7R shown in FIG. 4, since the conductor is one manufactured by constrictive processing, it has a hollow shape like a test tube. First earth ring 9R is formed into a ring shape centered on first center conductor 7R and having nearly the same height as first center conductor 7R, and earth terminals 8R, integral with first earth ring 9R, protrude, in the plane of installation face 300, from the two opposite sides of coaxial receptacle forming part 5R.

First earth ring 9R, in order to make engagement with coaxial plug 10P easy as well as certain, there is formed a tapered face 9*a*R the outer diameter of which is reduced toward the front end thereof and, in addition, there is formed an annular engagement recess 9*b*R with a V-shaped cross section by pressing an intermediate part in the height direction radially inward.

The cross section of first earth ring 9R having the shape as described above is designed to make it easy to insert coaxial plug 10P at the front part and to attain certain mating with coaxial plug 10P at the annular mating recess 9*b*R in the intermediate part. First earth ring 9R and earth terminal 8R are insert molded when manufacturing insulating housing 1R.

(Detailed Structure of the Coaxial Plug)

Figure 5:
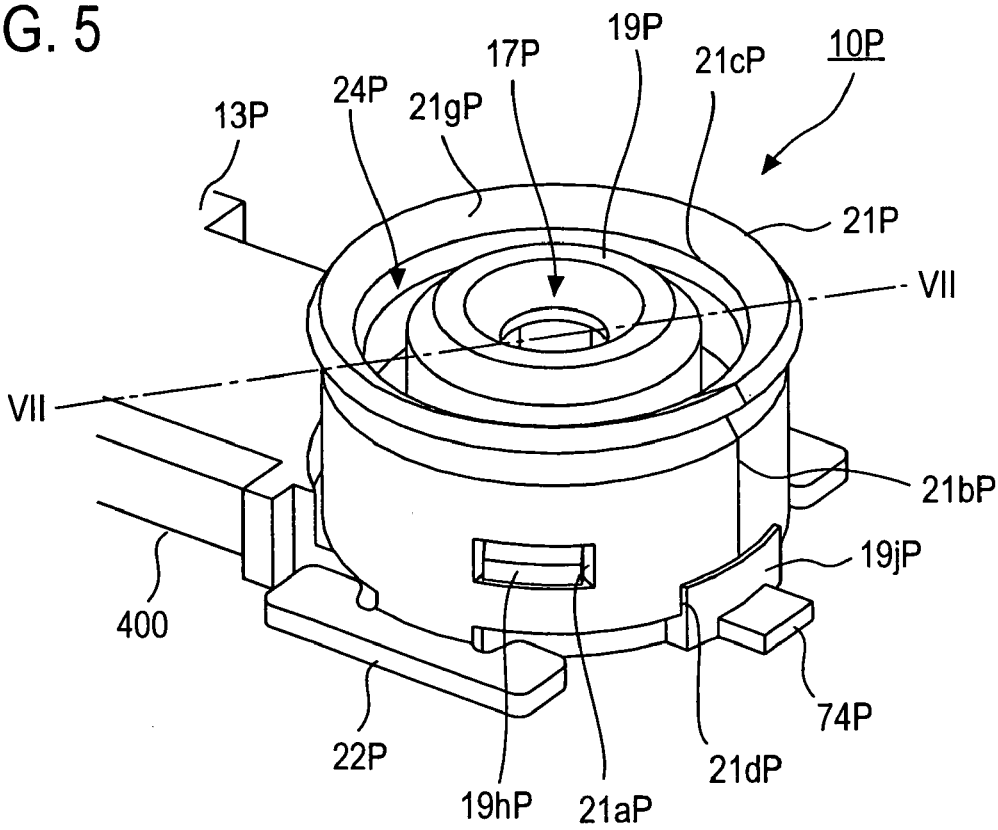
FIG. 5 is an enlarged oblique view of the coaxial plug in the plug shown in FIG. 1B.

FIG. 5 is an enlarged oblique view of coaxial plug 10P in plug 100P shown in FIG. 1B. For portions corresponding to those shown in FIG. 1B, like reference numerals are chosen and an explanation thereof is not repeated. Explanations are added by means of FIG. 5 regarding portions for which the structure becomes more clearly defined.

In second earth ring 21P, which has nearly the same height as cylindrical mounting part 19P, there is formed a tapered part 21*g*P for which the inner diameter of the front part of the earth ring gradually increases toward the front end, and there is formed, adjacent to the tapered part 21*g*P on the plug installation face 400 side, an annular engagement protrusion 21*c*P with a V-shaped cross section, the inner peripheral face of which protrudes inward. This annular engagement protrusion 21*c*P mutually engages annular engagement recess 9*b*R of first earth ring 9R and can maintain a stable connector engagement. A notch 21*d*P for restraining the circular movement of second earth ring 21P is formed in the bottom periphery and engaged with a positioning protrusion 19*j*P formed to protrude outward from the outer peripheral face of cylindrical mounting part 19P, whereby positioning of second earth ring 21P in a circumferential direction is achieved.

A slit 21*b*P is cut through from the center of notch 21*d*P of second earth ring 21P to the upper end of second earth ring 21P. However, it is acceptable to make the cut from the front end in the insertion direction and as far as the intermediate part, beyond engagement protrusion 21*c*P.

In the vicinity of an angle of approximately 60° in the circumferential direction from slit 21*b*P of second earth ring 21P, an engagement hole 21*a*P is formed in a position off the center of second earth ring 21P, in the height direction, toward plug installation face 400. This engagement hole 21*a*P is engaged with a claw 19*h*P, formed in the outer periphery of cylindrical mounting part 19P, and second earth ring 21P is fastened to insulating body 13P. Claws 19*h*P are formed in three places with a spacing of 120° in the circumferential direction, but only one can be seen in FIG. 5. Engagement holes 21*a*P of second earth ring 21P are also formed in three places corresponding to claws 19*h*P of cylindrical mounting part 19P.

With respect to cylindrical mounting part 19P, from the front end thereof, second earth ring 21P is installed so that notch 21*d*P mates with positioning protrusion 19*j*P of cylindrical mounting part 19P. At that point, second earth ring 21P is elastically pushed and widened in a radial direction by means of slit 21*b*P provided in second earth ring 21P, claws 19*h*P of cylindrical mounting part 19P and engagement holes 21*a*P of second earth ring 21P engage, and second earth ring 21P is fastened to insulating body 13P.

Figure 6:
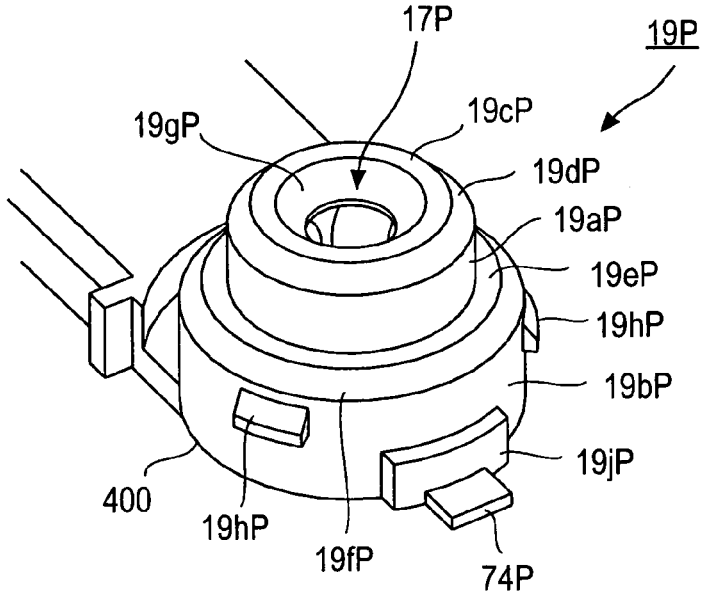
FIG. 6 is an oblique view of a cylindrically shaped mounting part 19P with the second earth ring taken out from FIG. 5.

In FIG. 6, there is shown an oblique view of a cylindrically shaped mounting part 19P with second earth ring 21P taken out from FIG. 5. Cylindrical mounting part 19P has a two-stage structure with a lower-side cylindrical part 19*b*P, having a diameter nearly identical to the inner diameter of second earth ring 21P, and an upper-side cylindrical part 19*a*P, having a diameter which is smaller than that of lower-side cylindrical part 19*b*P and nearly identical to the inner diameter of first earth ring 9R. On the upper face (facing away from plug installation face 400) of upper-side cylindrical part 19*a*P, insertion hole 17P, nearly identical in diameter to the diameter of first center conductor 7R of coaxial receptacle 10R, is made and pierced all the way to plug installation face 400. Near a front face 19*c*P of cylindrical mounting part 19P, the diameter of insertion hole 17P increases toward the front end to form a tapered face 19*g*P for facilitating easy insertion of first center conductor 7R into insertion hole 17P. Further, as for the outer periphery of cylindrical mounting part 19P, there is formed a tapered face 19*d*P, for which the outer diameter decreases toward front face 19*c*P, in order to make it easy to guide first earth ring 9R of coaxial receptacle 10R.

A step portion 19*e*P is formed in between upper-side cylindrical part 19*a*P and lower-side cylindrical part 19*b*P at a height where a distance from front face 19*c*P of upper-side cylindrical part 19*a*P is equal to or greater than the height of first earth ring 9R of coaxial receptacle 10R. At the outer peripheral corner of step portion 19*e*P, a tapered face 19*f*P is formed.

At the front end of second coaxial connector forming plate portion 16P, there protrudes a second center conductor terminal 74P coupled to second center conductor 70P. Positioning protrusion 19*j*P, centered on second center conductor terminal 74P and having a width approximately twice that of second center conductor terminal 74P, protrudes from lower-side cylindrical part 19*b*P and is formed integrally with lower-side cylindrical part 19*b*P.

Claws 19*h*P, formed in lower-side cylindrical part 19*b*P, have tapered faces wherein the thickness thereof increases as approaching plug installation face 400 and, if second earth ring 21P is installed in cylindrical mounting part 19P, claws 19*h*P, protruding from the outer peripheral face of lower-side cylindrical part 19*b*P, snap into engagement holes 21*a*P of second earth ring 21P.

Figure 8:
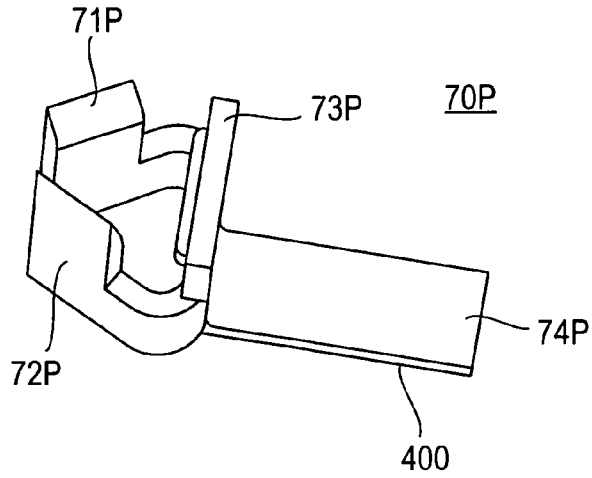
FIG. 8 is an oblique view showing a second center conductor.

FIG. 7 shows a cross-sectional view seen along line VII—VII in FIG. 5 showing coaxial plug 10P. Insertion hole 17P is bored all the way to plug installation face 400. As mentioned previously, insertion hole 17P at the upper end of cylindrical mounting part 19P has a circular shape, but closer to the mid-side, it is enlarged, there being formed a center conductor receiving compartment 19*m*P with a nearly square cross section in a plane perpendicular to the axis of cylindrical mounting part 19P. Inside the same center conductor receiving compartment 19*m*P, there are arranged, as shown in FIG. 8, second center conductor 70P provided with electrodes 71P, 72P, 73P so as to form a triangle. Claws 19*h*P formed on the outer peripheral face of lower-side cylindrical part 19*b*P engage engagement holes 21*a*P formed in second earth ring 21P, and second earth ring 21P and insulating body 13P become united in a single body.

In FIG. 8, the structure of second center conductor 70P is shown. Second center conductor terminal 74P, soldered to the wiring pattern on plug installation face 400, has a rectangular shape and is extended in parallel with plug installation face 400. Electrode 73P, of rectangular plate shape, is formed by extension in a direction perpendicular to plug installation face 400 from an edge of second conductor terminal 74P. The width of electrode 73P is slightly larger than that of second center conductor terminal 74P, and the height is nearly identical to the height of center conductor receiving compartment 19*m*P formed in the interior of cylindrical mounting part 19P. From the lower halves of both sides of electrode 73P, the front ends are bent over inward and extended so as to mutually approach, to form a triangle. The upper edges of the two extended portions are extended away from installation face 400 up to the same height as that of electrode 73P to form electrodes 71P and 72P. The upper ends of electrodes 71P and 72P have formed therein tapered faces so that the opening of the triangle becomes bigger toward the upper side. The diameter of the circle inscribed in the triangle formed by electrodes 71P, 72P, 73P is set to be smaller than the diameter of first center conductor 7R to be inserted into the triangle. Consequently, if first center conductor 7R is inserted, electrodes 71P, 72P of second center conductor 70P are elastically deformed in a direction in which they are mutually separated.

Figure 9:
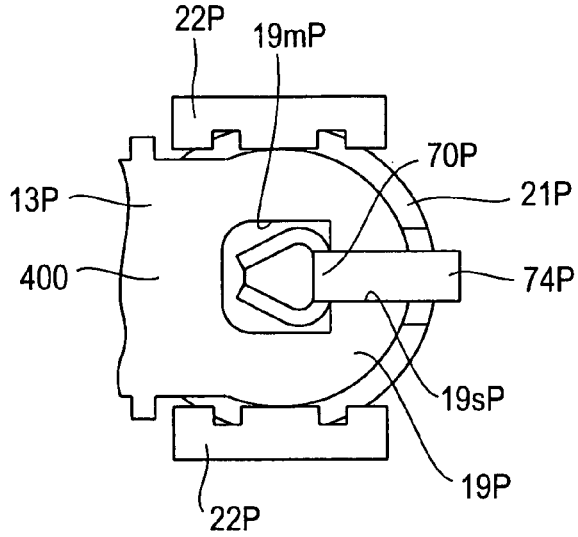
FIG. 9 is a diagram showing the situation in which the second center conductor is fastened to an insulating body.

In FIG. 9, there is shown a diagram of the situation in which second center conductor 70P is fastened to insulating body 13P, seen from plug installation face 400. Portions explained so far are chosen to have like reference numerals and an explanation thereof will not be repeated. Second center conductor 70P is inserted from plug installation face 400 into center conductor receiving compartment 19*m*P having nearly a square cross section in the axial direction of cylindrical mounting part 19P. Second center conductor 70P is fastened by mating to a fastening groove 19*s*P formed on the plug installation face 400 side of second coaxial connector forming plate portion 16P, and a second center conductor terminal 74P is made to protrude in the plane of plug installation face 400 of the end portion of second coaxial connector forming plate portion 16P.

In FIG. 10, there is shown a cross-sectional view of a state where coaxial receptacle 10R and coaxial plug 10P are mated. First center conductor 7R constituting coaxial receptacle 10R is inserted from installation face 300 into installation hole 30R made in the center portion of coaxial receptacle forming part 5R and is arranged in a standing condition perpendicular to installation face 300. First center conductor terminal 6R, integral with first center conductor 7R and parallel with installation face 300, is fastened by mating to groove 31R formed in the installation face 300 side (the back face of coaxial receptacle forming part 5R) of coaxial receptacle 5R and protrudes from the end of coaxial receptacle forming part 5R in the same plane as installation face 300 of coaxial receptacle forming part 5R.

First center conductor 7R is inserted in insertion hole 17P and contacts the upper portions, i.e. electrodes 71P, 72P, 73P, of second center conductor 70P arranged inside center conductor receiving compartment 19*m*P. The upper end of second earth ring 21P (facing away from plug installation face 400) has a bell-shaped opening outward so as to make it easy for first earth ring 9R of coaxial receptacle 10R to mate. Stated the other way round, the root of the bell-shape protrudes radially inward from the inner peripheral face of second earth ring 21P so that the aforementioned engagement protrusion 21*c*P is formed. Since the inner diameter of the engagement protrusion 21*c*P is formed to be somewhat smaller than the maximum outer diameter of first earth ring 9R, first earth ring 9R inserted into second earth ring 21P elastically pushes and enlarges second earth ring 21P and engagement protrusion 21*s*P engages engagement recess 9*b*R, thus it is possible to increase the stability of the coupling of coaxial receptacle 10R and coaxial plug 10P. Since it is common particularly for small-sized coaxial connectors called push-on connectors to have displacement portions only in the direction of the axis of coupling, this embodiment has a structure which is advantageous over the conventional push-on connectors.

Figure 11A:
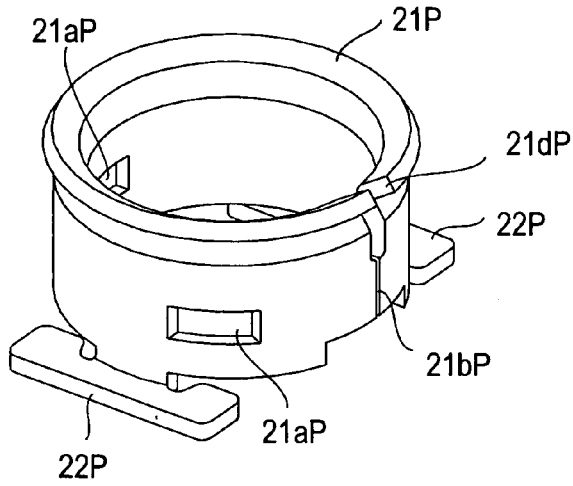
FIG. 11A is an oblique view showing a first example in which the shape of a variable-diameter earth ring has been changed.
Figure 11B:
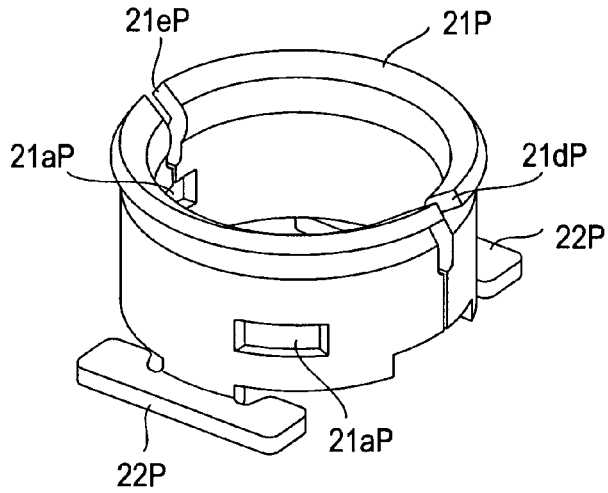
FIG. 11B is an oblique view showing a second example in which the shape of a variable-diameter earth ring has been changed.
Figure 11C:
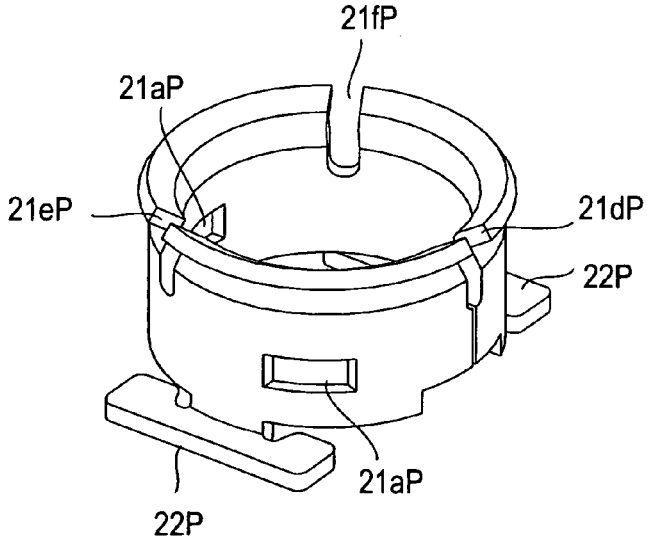
FIG. 11C is an oblique view showing a third example in which the shape of a variable-diameter earth ring has been changed.

As for the elastic coupling power of first earth ring 9R and second earth ring 21P, it is possible to adjust it by changing the shape of e.g. second earth ring 21P. Examples thereof are shown in FIGS. 11A, 11B, and 11C. FIG. 11A is a case wherein only slit 21*b*P, which is a break in the ring of second earth ring 21P formed by press working of one metal sheet is used as a slit 21*d*P to make the elastic coupling power smaller than for a continuous ring. It is possible to make the mating power weaker when coaxial receptacle 10R couples with coaxial plug 10P by the fact that slit 21*d*P (21*b*P) is formed, since it becomes easier for second earth ring 21P to open outward.

FIG. 11B is an example wherein, in order to make the coupling power weaker than for the example of FIG. 11A, there is formed a second slit 21*e*P at a position opposite from slit 21*d*P on a diameter of second earth ring 21*d*P. In this example, slit 21*e*P communicates with engagement hole 21*a*p.

FIG. 11C is an example wherein slits 21*e*P, 21*f*P are formed at positions of approximately ±120° in the circumferential direction, taking 21*d*P as the reference. By forming additional slits in this way, it is possible to further make the coupling power weaker. It is of course also possible to adjust the mating power by changing the wall thickness, the diameter, and the material of first earth ring 9R and second earth ring 21P.

(Contact Point Structure of Multi-Connector)

Figure 12:
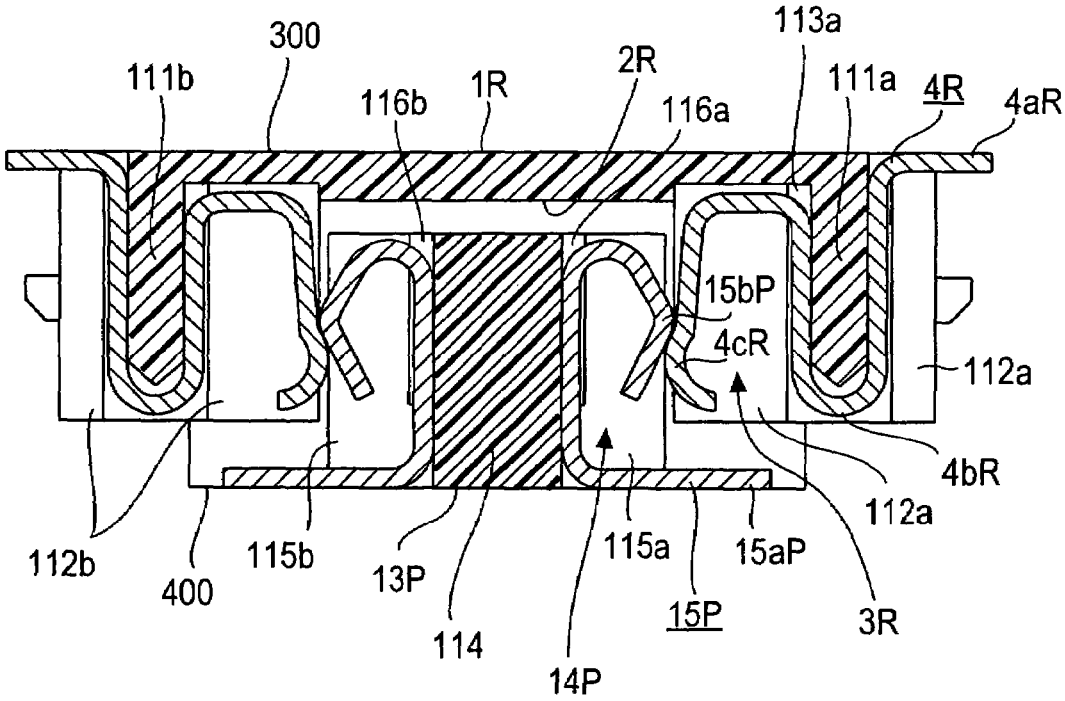
FIG. 12 is a cross-sectional view in a state where the multi-connector receptacle and the multi-connector plug shown in FIG. 1C are mated, seen along line XI—XI.

In FIG. 12, there is shown a cross-sectional view seen along line XI—XI in a state where the multi-connector shown in FIG. 1C is coupled. In this example, both the receptacle and the plug are configured with a cross section having a left-right symmetry. Consequently, the explanation will mainly be carried out regarding one side.

First, the structure on the receptacle side will be explained.

In insulating housing 1R, retaining walls 111*a* and 111*b*, fastening a receptacle contactor 4R vertically on the side facing away from installation face 300 of the insulating housing, are extended in the longitudinal direction of insulating housing 1R to form therebetween insertion recess 2R. Partition walls 112*a*, extending from and at right angles with retaining wall 111*a* toward insertion recess 2R, are formed plurally with a fixed spacing slightly larger than the width of receptacle contactor 4R in the longitudinal direction of insulating housing 1R, and between each pair of adjacent partition walls 112*a*, there is formed a contactor accommodating slot 3R. Each partition wall 112*a* also projects to the side facing away from insertion recess 2R. In each contactor accommodating slot 3R, there is formed, as a contactor fastening groove 113*a*, a groove with the same width as the conductor wire forming receptacle contactor 4R in the peripheral face of retaining wall 111*a*.

Each receptacle contactor 4R has a terminal 4*a*R extending in parallel with installation face 300. Each receptacle contactor 4R is extended from terminal 4*a*R toward insertion recess 2R, rises (in FIG. 12, descends) in a vertical direction through contactor fastening groove 113*a* of retaining wall 111*a*, and is folded back in a hairpin shape by the upper end of retaining wall 111*a* to form a mounting hairpin part 4*b*R. Further, it is extended past contactor fastening groove 113*a* toward installation face 300 of insulating housing 1R, and is again bent over in the shape of a U at the bottom part of insulating housing 1R to form a movable contact part 4*c*R with nearly the same height as the upper end of retaining wall 111*a*. Movable contact part 4*c*R is formed in an arcuate shape having an apex protruding out from retaining wall 112*a* into the insertion recess 2R side. The configuration that receptacle contactor 4R is bent over in the shape of a U and extended around the bottom part of insulating housing 1R, provides receptacle contactor 4R with a spring force in a transverse direction from insertion recess 2R toward retaining wall 111*a*.

Next, the plug side will be explained.

Insulating body 13P has a center wall 114 perpendicular to the plug installation face 400 thereof and extended in the longitudinal direction of the plug. Partition walls 115*a*, 115*b* are formed to project at right angles from center wall 114 in both outward directions, and has formed therein plug contactor accommodating slots 14P between adjacent partition walls.

As for the sizes of partition walls 115*a*, 115*b* and center wall 114, their widths are selected so that the sum of these widths may be slightly shorter than the width of insertion recess 2R. Inside each plug contactor accommodating slot 14P, on both side faces of center wall 114, there are formed, as plug contactor guiding grooves 116*a*, 116*b*, grooves serving as guides when inserting plug contactor 15P in insulating body 13P.

Plug terminal 15*a*P, forming one end of plug contactor 15P, extends all the way to center wall 114 from the outer side of insulating body 13P in the same plane as plug installation face 400, rises in a vertical direction to extend past plug contactor groove 116*a*, and is folded back at a position just in front of the top face of insulating body 13P, the other end of the folded back plug contactor 15P being bent so as to form a hill protruding away from center wall 114 and acting as a plug contact part 15*b*P.

Insulating body 13P of the plug is inserted into insertion recess 2R, while the side end faces of partition walls 115*a*, 115*b* forming plug contactor accommodating slots 14P are slideably guided by the side end faces of partition walls 112*a*, 112*b* which determine the length in the short side direction of receptacle insertion recess 2R. When insulating body 13P is inserted, the protruding angled part of contact part 15*b*P of each plug contactor 15P clears the arcuately formed movable contact part 4*c*R of receptacle contactor 4R, and contact is established between the contactors. In this state, receptacle contactor 4R and plug contactor 15P stably support a state of mutual contact with pressure by the spring force in the direction of short side of insertion recess 2R. Since the respective receptacle contactor 4R and plug contactor 15P have a spring force and make contact in this way, an excellent connection is obtained.

By proceeding in this way, electrical continuity between signals on receptacle installation face 300 and signals on plug installation face 400 is obtained.

2. Second Embodiment

Figure 13A:
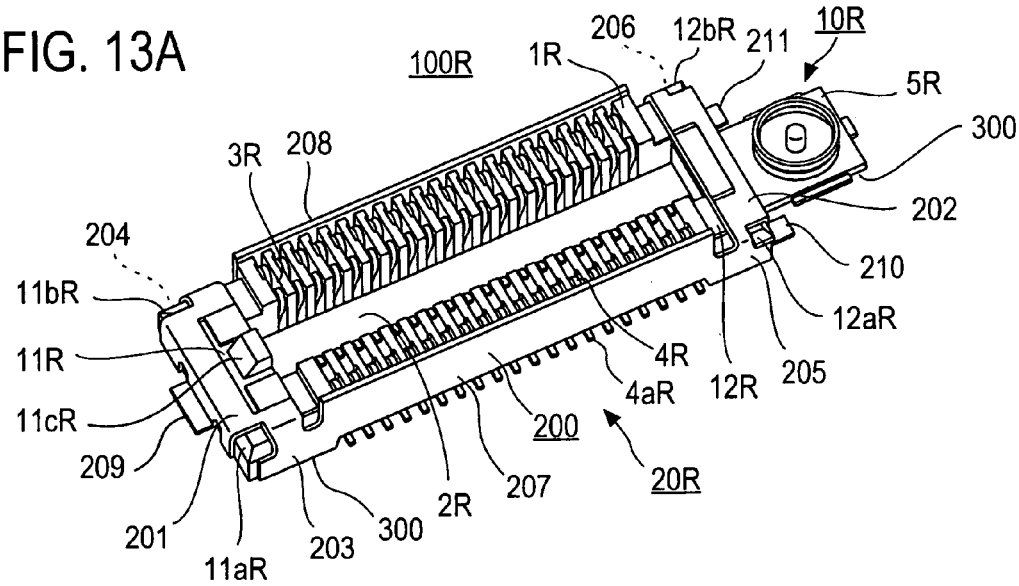
FIG. 13A is an oblique view of a receptacle of another embodiment of this invention in which the multi-connector receptacle has been electro-magnetically shielded.
Figure 13B:
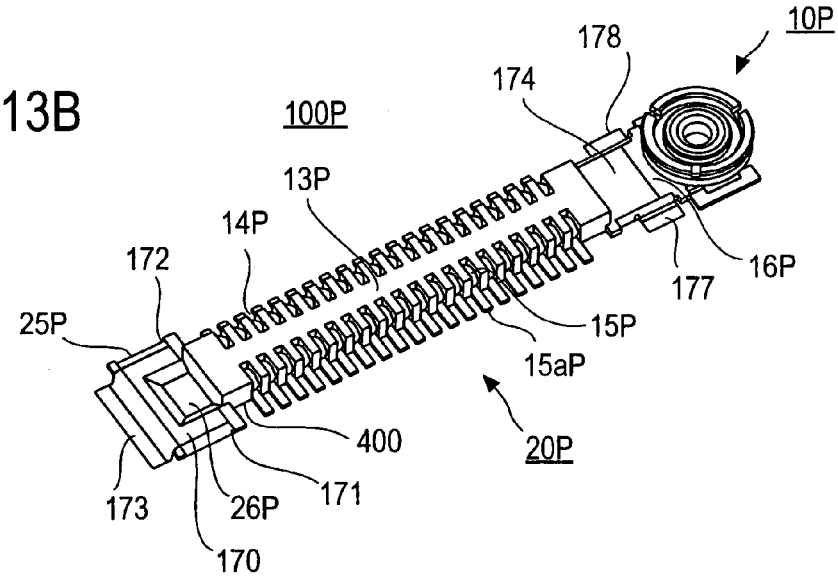
FIG. 13B is an oblique view of a plug of another embodiment of this invention in which the multi-connector plug has been electro-magnetically shielded.
Figure 13C:
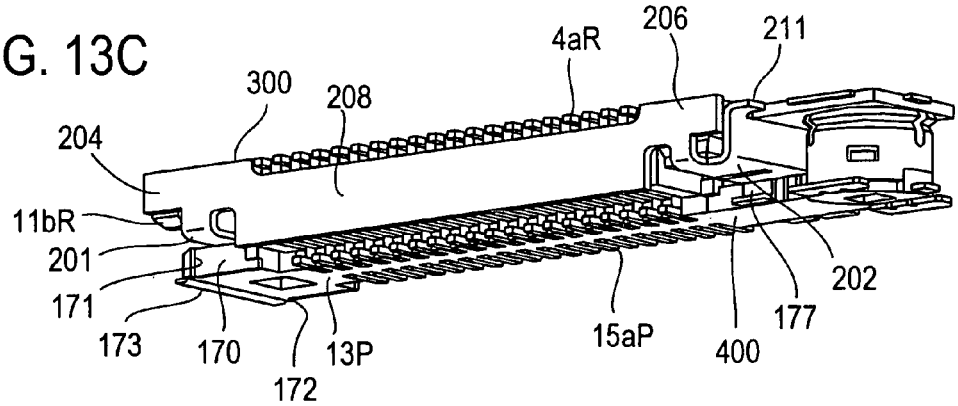
FIG. 13C is an oblique view of a state in which the receptacle and the plug are joined in an embodiment wherein the multi-connector part is electro-magnetically shielded.
Figure 14A:
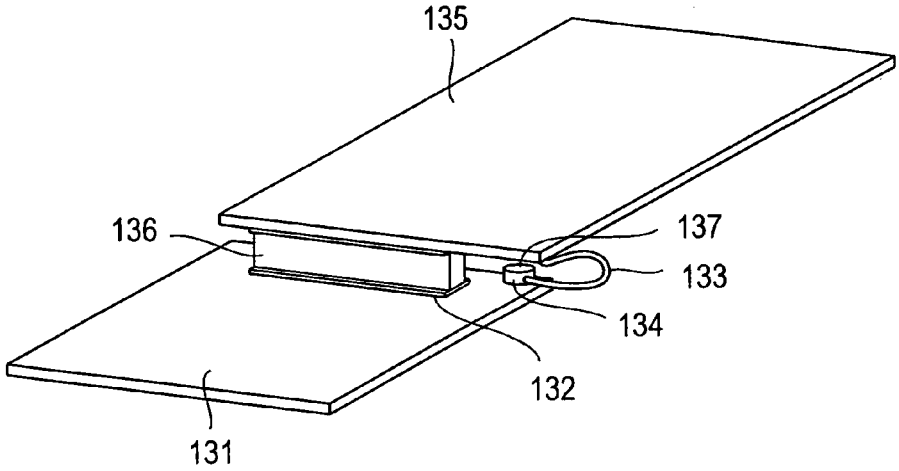
FIG. 14A is an oblique view showing an example of conventional connection between boards.
Figure 14B:
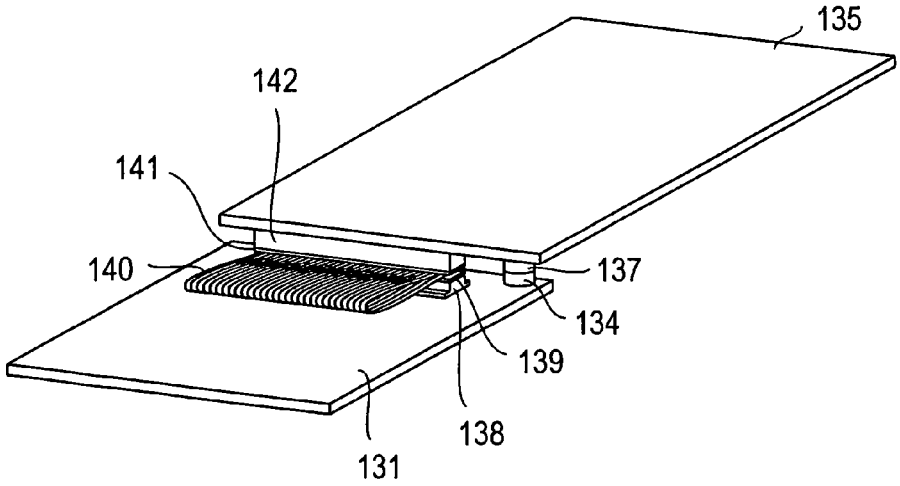
FIG. 14B is an oblique view showing another example of conventional connection between boards.

The contacts of the aforementioned multi-connector part are transmission lines in which characteristic impedances are not taken into account. If the multi-connector also attempts to adapt the characteristic impedances, as described in the prior art, there has been the problem that the whole connector ended up becoming larger in size. Then, there is also a demand of wanting to electro-magnetically shield the multi-connector part, even though there is no need to go to the extent of matching the characteristic impedances. Another embodiment of this invention which responds to this demand is shown in FIGS. 13A, 13B, and 13C, and this invention will be explained further. As for portions explained so far, reference numerals are taken to be the same and an explanation thereof will not be repeated. Explanations are added by means of FIGS. 13A, 13B, and 13C regarding portions for which the structure becomes more clearly defined.

(Structure of the Receptacle of the Second Embodiment)

In FIG. 13A, a receptacle 100R of the second embodiment is shown. At both ends, opposite in the longitudinal direction, of insertion recess 2R, there are arranged fixing plates 201, 202. Fixing plate 201 envelops one receptacle end portion 11R which is lower than insulating housing 1R in the plane of installation face 300. Fixing plate 202 envelops the other receptacle end portion 12R having the same height as receptacle end portion 11R.

At the upper corners of receptacle end parts 11R, 12R, there are formed latching claws 11*a*R, 11*b*R, 12*a*R, 12*b*R, which not only protrude away from installation face 300 but which also protrude outward from both lateral faces of insulating housing 1R. As for receptacle end portions 11R, 12R, the top face, both lateral faces, and the end face thereof are respectively enveloped by fixing plates 201, 202 while avoiding latching claws 11*a*R, 11*b*R, 12*a*R, 12*b*R. The portions of fixing plates 201, 202, which envelop the lateral faces of receptacle end parts 11R, 12R, pass between 11*a*R, 11*b*R, 12*a*R, 12*b*R and installation face 300 and are extended all the way to the end sides of receptacle end parts 11R, 12R to form latching parts 203, 204, 205, 206.

The portion of fixing plate 201 which envelops the end face facing away from insertion recess 2R is extended all the way to installation face 300 and a fixing leg 209, at which fixing plate 201 is soldered to the grounding pattern of installation face 300, is formed in the center of the end side by being bent over outward and extended.

The portion of the side opposite from insertion recess 2R, of fixing plate 202 enveloping receptacle end portion 12R is extended while avoiding latching claws 12*a*R, 12*b*R and bent over all the way to the top face of coaxial connector forming plate portion 5R, and, further, lateral portions of the extended portion on both sides of coaxial connector forming plate portion 5R are extended all the way to installation face 300 and bent over outward so that fixing legs 210, 211 are formed.

The contactor accommodating slot 3R side of latching part 203, 204 are extended all the way to latching parts 205, 206, with its height held from above the aligned terminals 4*a*R of receptacle contactors 4R to above the top face of insulating housing 1R (facing away from installation face 300), and merged to latching parts 205, 206 to form shield plates 207, 208 enveloping the lateral faces of insulating housing 1R.

Shield plates 207, 208 and fixing plates 201, 202 at the two opposite ends of insertion recess 2R in its longitudinal direction, are formed from one metal plate into one unit by press working to constitute a shielding-and-fixing plate 200. Shielding-and-fixing plate 200 makes up one unit with insulating housing 1R by engaging latching claws 11*a*R, 11*b*R, 12*a*R, 12*b*R formed in the four corners of insulating housing 1R with latching parts 203, 204, 205, 206.

(Configuration of the Plug of the Second Embodiment)

In FIG. 13B, plug 100P of the second embodiment is shown. At one longitudinal direction end of insulating body 13P, there is provided a second coaxial connector forming plate portion 16P, and coaxial plug 10P is formed thereon. Plug end portion 25P is extended integrally from one longitudinal end of insulating body 13P on the plug installation face 400 side lower and with a larger width than the top face of insulating body 13P. In nearly the center portion of plug end portion 25P, there is formed an engagement hole 26P engaging engagement protrusion 12R of receptacle 100R, and at the perimeter of engagement hole 26P, there is arranged a plug fixing metal plate 170 for making contact with fixing plate 201 of receptacle 100R in a mating state. Plug fixing metal plate 170 engages recesses 171, 172 formed in both lateral faces along the longitudinal direction of insulating body 13P and is fastened to form one unit with insulating body 13P. On the side of plug fixing metal plate 170 which faces away from the direction in which plug contactors 15P are arranged, there is formed a plug fixing leg 173 for fastening the plug securely to plug installation face 400.

Between insulating body 13P and coaxial plug 10P, another plug fixing metal plate 174 is provided. Plug fixing metal plate 174 is bent over along the two lateral faces along the longitudinal direction of insulating body 13P, is extended all the way to plug installation face 400, and is fastened to the lateral faces to form one unit with insulating body 13P. The extended parts are further bent over mutually outward in the plane of plug installation face 400 to form plug fixing legs 177, 178 for securely fixing the plug to not-shown board.

(Mating of the Receptacle and the Plug of the Second Embodiment)

FIG. 13C shows an oblique view which receptacle 100R and plug 100P of the second embodiment are mated. In FIG. 13C, the respective separate boards on which the receptacle and the plug are installed are omitted. FIG. 1C is a diagram in which engagement protrusion 12R of receptacle 100R in FIG. 13A is engaged in engagement hole 26P of the plug, insulating body 13P is inserted in insertion recess 2R, and coaxial receptacle 10R and coaxial plug 10P are mated. Portions which have been explained so far are taken to have the same reference numerals and an explanation thereof will be omitted.

At the two end portions in the longitudinal direction of insulating body 13P constituting the main body of the plug, there are arranged plug fixing metal plates 170, 174, which respectively contact fixing plates 201, 202 on the side of the mated receptacle. Both lateral faces in the longitudinal direction of the mated receptacle and plug are enveloped by shield plates 207, 208 from just below terminals 4*a*R of receptacle contactors 4R, located in positions on installation face 300 of the board on which the receptacle is installed, all the way to a height just above terminals 15*a*P of plug contactors 15P located in positions on installation face 400 of the board on which the plug is installed.

By soldering and conductively connecting fixing plates 201, 202 on the receptacle side to ground electrodes on the board on which the receptacle is installed, it is possible to electro-magnetically shield both lateral faces of a multi-connector.

Also, by soldering plug fixing metal plates 170, 174 to ground electrodes on the side of the board on which the plug is installed, it is possible to bring in common the ground potentials of the board on which the receptacle is installed and the board on which the plug is installed.

In this way, according to the second embodiment, it is possible to configure an electro-magnetically shielded transmission path whose characteristic impedance is adjusted, and an electro-magnetically shielded multi-connector into one set of receptacle and plug. In the embodiments explained so far, the explanation has been made using an example in which the coaxial connector is arranged at one end portion in the longitudinal direction of a rectangular parallelepiped shaped insulating housing, forming a parallel connector part, and an insulating body, but coaxial connectors may also be arranged at both end portions.

Further, as for the mating force between the coaxial receptacle and the coaxial plug, it is possible to adjust mating force with the number of slits in a variable-diameter earth ring, material, thickness, and the like, of the variable-diameter earth ring, but, it is also acceptable to leave out the fixing plates formed on the coaxial connector side depending on the mating force.

What is claimed is:

1. A coaxial connector integrated connector for board connection, including:

a receptacle including an insulating housing in which there is formed, in the center part of a face and along the longitudinal direction thereof, a recess for insertion of a companion plug, and a first coaxial connector formed at one longitudinal end portion of said insulating housing in which there are respectively disposed and formed contactor accommodating slots, with a fixed pitch on opposite faces along the longitudinal direction of said insertion recess, and there is held a receptacle contactor in each contactor accommodating slot; and a plug including an insulating body mating with said insertion recess and a second coaxial connector mating with said first coaxial connector and formed at one longitudinal end portion of said insulating body in which there are disposed and formed, on both longitudinal direction sides of said insulating body, plug contactor accommodating slots, with the same pitch as described above, and there are stored plug contactors in said plug contactor accommodating slots;

wherein said receptacle has a first coaxial connector forming plate portion with a flat plate shape which is formed integrally by extension in a longitudinal direction from said longitudinal end portion of said insulating housing and is perpendicular to the connector coupling direction;

said plug has a second coaxial connector forming plate portion with a flat plate shape which is formed integrally by extension in a longitudinal direction from said longitudinal end portion of said insulating body and is perpendicular to the connector coupling direction;

said first coaxial connector comprises a first center conductor protruding and provided in the center part of said first coaxial connector forming plate portion, and a ring-shaped first earth ring which is mounted on said first coaxial connector forming plate portion and centered on the same first center conductor;

said second coaxial connector comprises a cylindrical mounting part formed integrally in the center part of said second coaxial connector forming plate portion opposite in the mating direction to said first coaxial connector, a second center conductor in which there is opened an insertion hole in the center of the mating direction top face of said cylindrical mounting part, into which hole said first center conductor is inserted and the second center conductor is arranged in the interior of said insertion hole, and a ring-shaped second earth ring installed in said cylindrical mounting part;

in said second earth ring, one or more slits parallel with the mating direction to said first coaxial connector are formed from the end portion of said cylindrical mounting part opposite to said second coaxial connector forming plate portion; and said second center conductor is formed with the possibility of elastic displacement in a direction perpendicular to the axis.

2. The connector according to claim 1, wherein said first coaxial connector forming plate portion is formed to be thinner than the thickness of the portion in which the contactor accommodating slots of said insulating housing are formed, and said second coaxial connector forming plate portion is formed to be thinner than the thickness of the portion in which the contactor accommodating slots of said insulating body are formed.

3. The connector according to claim or 2, wherein said first center conductor and said first earth ring are formed integrally to said first coaxial connector forming plate portion, said cylindrical mounting part includes a first cylindrical part having a first outer diameter and a second cylindrical part formed integrally to one end of said first cylindrical part and having a second outer diameter which is smaller than said first outer diameter, and said first earth ring is inserted between said second cylindrical part and said second earth ring.

4. The connector according to claim 2, wherein a face of said first coaxial connector forming plate portion, opposite a side where said first center conductor is provided, is in the same plane as the insulating housing installation face formed integrally with said first coaxial connector forming plate portion, and a face of said second coaxial connector forming plate portion, opposite a side where said cylindrical mounting part is formed, is in the same plane as the installation face, of said insulating body, formed integrally with said second coaxial connector forming plate portion.

5. The connector according to claim 1, or 2, comprising fixing plates, composed of metallic material, enveloping both longitudinal direction end portions of said insulating housing, and shield plates formed integrally with both said fixing plates and enveloping both longitudinal direction lateral faces of said insulating housing.

6. The connector according to claim 1, wherein in said second earth ring has a plurality of said slits and wherein said slits are formed with mutual spacings in the circumferential direction.

7. The connector according to claim 1, wherein said insertion hole has a tapered face, the diameter of which increases with increasing separation from said second coaxial connector forming plate portion.

* * * * *